US008986412B2

(12) United States Patent
Jansen et al.

(10) Patent No.: US 8,986,412 B2
(45) Date of Patent: Mar. 24, 2015

(54) PIPE AND GUIDE ELEMENT FOR INSTALLATION IN A PIPE

(75) Inventors: Matthias Jansen, Stolberg (DE); Peter Wandres, Aachen (DE); Joachim Frahm, Herzogenrath (DE); Roland Krauss, Hueckelhoven (DE); Helmut Kanka, Duisberg (DE); Juergen Schmitz, Aachen (DE)

(73) Assignee: Munters Euroform GmbH, Aachen (DE)

( * ) Notice: Subject to any disclaimer, the term of this patent is extended or adjusted under 35 U.S.C. 154(b) by 599 days.

(21) Appl. No.: 13/262,287

(22) PCT Filed: Mar. 26, 2010

(86) PCT No.: PCT/DE2010/000358

§ 371 (c)(1),
(2), (4) Date: Jan. 30, 2012

(87) PCT Pub. No.: WO2010/115402

PCT Pub. Date: Oct. 14, 2010

(65) Prior Publication Data

US 2012/0117929 A1 May 17, 2012

(30) Foreign Application Priority Data

Apr. 7, 2009 (DE) ..... 10 2009 016 643

(51) Int. Cl.
*B01D 45/08* (2006.01)
*F23J 13/00* (2006.01)
*F23M 9/00* (2006.01)
*F23M 9/08* (2006.01)

(52) U.S. Cl.
CPC ..... *F23J 13/00* (2013.01); *F23M 9/003* (2013.01); *F23M 9/08* (2013.01)
USPC ..... 55/456; 55/447; 55/457; 55/423; 55/466

(58) Field of Classification Search
USPC ..... 55/447, 456, 457, 423, 466
See application file for complete search history.

(56) References Cited

U.S. PATENT DOCUMENTS

| | | | | |
|---|---|---|---|---|
| 2,020,194 A | | 11/1935 | Kulhmann | |
| 4,953,535 A | | 9/1990 | Hagan | |
| 5,113,671 A | * | 5/1992 | Westermeyer | 62/468 |
| 5,411,013 A | | 5/1995 | Kazen | |

FOREIGN PATENT DOCUMENTS

| | | |
|---|---|---|
| DE | 29815970 U | 4/1999 |
| WO | 9504246 A | 2/1995 |
| WO | 9512784 A | 5/1995 |

* cited by examiner

*Primary Examiner* — Dung H Bui
(74) *Attorney, Agent, or Firm* — Andrew Wilford

(57) ABSTRACT

A tube for the conduction or discharge of wet flue gases subjected to a scrubbing has a helically formed guide element on an inner surface of the tube and having a plurality of turns. A film trap is provided on the inner surface of the tube between adjacent turns of the guide element.

16 Claims, 3 Drawing Sheets

PIPE AND GUIDE ELEMENT FOR INSTALLATION IN A PIPE

CROSS REFERENCE TO RELATED APPLICATIONS

This application is the US-national stage of PCT application PCT/DE2010/000358 filed 26 Mar. 2010, published 14 Oct. 2010 as WO2010/115402, and claiming the priority of German patent application 102009016643.2 itself filed 7 Apr. 2009.

FIELD OF THE INVENTION

The present invention is directed to a tube for the conduction or discharge of wet gases, especially for the conduction or discharge of flue gases subjected to a scrubbing (wet cleaning).

BACKGROUND OF THE INVENTION

Downstream of scrubbers (wet cleaners), for instance downstream of scrubbers of flue gases, up to now preheating means in the form of heat exchangers or by the direct application of is energy by means of gas burners have been used in order to transport the wet gas through large chimneys having a height of up to 400 m. In this manner, the ejection of coarse droplets from the chimney that fall down in the direct vicinity of the chimney should be avoided. However, these installations are very expensive and need an extensive maintenance or have a high energy consumption.

Accordingly, modern installations are equipped with so-called wet chimneys that have a height of about 250 m. Here, the gas transport occurs with the assistance of pressure increasing blowers upstream of or downstream of the scrubber. A high condensate generation results within the chimney on account of the cooling of the wet gas on the way to the exit of the chimney so that the ejection of coarse droplets from the chimney results that fall down in the direct vicinity of the chimney (installation, village). Up to now, apart from simple drainage means, only in few cases installations, as for instance axial cyclones, were provided in the large chimneys since the same result in very high energy losses on account of the high speeds in the chimney and up to now do not represent a satisfying solution with respect to the discharge of droplets.

Furthermore, so-called film traps or other baffles have been installed in many wet chimneys for the reduction of the droplet ejection. Such film traps prevent the entraining of liquid films along the chimney wall. However, these measures are normally only conditionally usable since the liquid film is entrained or droplets are dragged-out from the film on account of the high gas speeds in such chimneys. Accordingly, a detrimental droplet ejection cannot be completely prevented even with such installations.

From DE 298 15 970 U1 a chimney tube with inner profilation for a wet chimney is known wherein the condensation in the chimney tube is to be improved by the provided inner profilation etc.

In WO 95/12784 a condensation chimney is described wherein the wet, cold, condensing chimney has an outer chimney wall in the inner space of which an inner tube is arranged. A profile tube is used as inner tube in order to enlarge the contact surface for the flue gas.

From WO 95/04246 a chimney is known that is provided with a plurality of packings in order to increase the amount of condensate. The used packings are semi-spherically formed and realized as grid construction.

OBJECT OF THE INVENTION

The present invention is based on the object to provide a tube according to which an entrainment of droplets or an ejection of droplets is prevented or reduced with especially simple means with simultaneous small energy loss.

SUMMARY OF THE INVENTION

This object is achieved with a tube of the kind described above by the feature that it has a helically formed guide element at its inner wall.

According to the inventive solution the gas flow is rotated by the helically formed guide element at the inner wall of the tube in such a manner that the droplets entrained in the gas flow arrive at the inner wall of the tube by the centrifugal force of the rotating gas flow and can be discharged from this point in an intended manner and with calmed flow. Accordingly, the guide element provided according to the invention fulfils a double function. On the one hand it provides the gas flow with a rotary movement or helical movement and on the other hand the guide element serves for catching and discharging the liquid droplets collected at the inner wall of the tube. Accordingly, the above-cited problem is solved with especially simple means. Furthermore, the provided guide element has the advantage that the energy loss of the gas flow generated by its installation is small and especially substantially smaller than with conventional axial cyclones.

Of course, the guide element provided according to the invention can extend over the total length or only over a part of the total length of the tube. The guide element extends spirally or helically over the inner wall of the tube and is fixed to it in a suitable manner or is integrally formed with it (by welding).

The dimensioning of the guide element depends on the flow conditions present in the tube. However, the following embodiments of the provided guide element are especially preferred.

Preferably, the guide element has a width of 1/80 D to 1/5 D where D is the inner diameter of the tube. Especially preferred is a width of 1/20 D. Accordingly, the guide element extends preferably in the interior of the tube at maximum over a distance inwardly that corresponds to 10% of the inner diameter of the tube. In this manner too high an energy loss of the gas flow is prevented.

The pitch of the guide element is preferably in a range of ½ D-10 D where a pitch of ½ D is especially preferred. Since the guide element simultaneously serves for the discharge of the liquid droplets collected at the inner wall of the tube the pitch should be selected in such a manner that a correct discharge of the liquid is guaranteed.

According to another preferred embodiment of the invention the inclination of the guide element from the center of the tube to the inner wall of the tube is 0°-60°. A preferred angle of inclination amounts to 7°. Although the guide element can also have an inclination of 0°, a certain inclination from the center to the inner wall is preferred in order to form a kind of liquid duct or groove by means of which the discharge of the liquid is possible without having the liquid dropping into the inner space between the guide element so that the danger of entrainment of droplets exists.

Another preferred embodiment is characterized by the feature that the inner edge of the guide element is canted, preferably in gas flow direction. By this, swirling of the flow downstream of the guide element is prevented. Furthermore, this arrangement serves for the reduction of the pressure loss of the system and for the prevention of reentry of liquid into the main flow and thus to avoid entrainment of droplets. The height of the canting is preferably 1/200 D-1/40 D.

The guide element can be plate-like plane element. However, other embodiments are also possible that are structured in cross-section. So, an embodiment is preferred according to which the guide element is formed concave over its width that favors the liquid discharge especially. Convex embodiments are also possible. Preferred are plane up to concave embodiments.

Practically, the guide element has at least one weir provided with a discharge channel. This weir serves for the liquid discharge wherein it stems the corresponding liquid that is then discharged through a discharge channel that preferably extends through the wall of the tube outwardly. Appropriately, weirs with discharge channels distributed over the total height of the tube and thus of the guide element are installed wherein the discharge channels are preferably submerged through siphons. In this manner, a discharge of the collected liquid on different levels of the tube results so that it is avoided that collected liquid, when flowing down, re-enters into the main flow into the inner space.

With the inventive tube the inner wall of the tube can be also formed by an inner tube arranged in an outer casing wherein the guide element is removably or non-removably fixed at the inner tube. The inner tube and the guide element can form a construction unit that is inserted into an outer casing. Of course, such an inner tube can also have a plurality of portions that can be mounted one upon another.

The inventive tube serves for the conduction or for the discharge of gases. Here, the inventive measures serve for avoiding an entraining of droplets in the gas flow or an ejection of droplets when the tube discharges the gas into the atmosphere. The tube provided with the guide element can be also designated as a kind of pre-separator (especially with closed tube systems).

Preferably, the tube is formed as wet chimney wherein here the object is in the foreground to prevent an ejection of droplets of the wet chimney.

According to another embodiment of the invention the tube has a film trap for the liquid film pushed along the inner wall of the tube at its inner wall between adjacent portions of the guide element. Namely, if the gas flow has come into rotation just in the edge range high tangential speeds can occur that then can drive the liquid film at the lower side of the guide element upwardly in a helical manner. This effect shall be prevented by the provided film trap.

The film trap can be formed by an axially extending plane or curved web, for example. The curved web is concavely formed with regard to the direction in which the liquid film is displaced in order to serve as catching means. Preferably, the film trap has one or more discharge pipes so that the captured liquid can be discharged out of the tube or from the tube.

According to another embodiment of the invention the film trap is formed by an axially extending discharge pipe into which the guide element opens or that is crossed by the guide element. Hereby, the discharge pipe arranged at the inner wall of the tube forms with its outer surface a film trap and serves simultaneously for the discharge of the liquid film at its outer surface that, at the places at which the discharge pipe is interrupted and bridges the guide element, is introduced into the discharge pipe together with the liquid discharged by the guide element. Preferably, the discharge pipe bridges over the range of the guide element by means of a pipe narrowing so that at this place not only the liquid in the discharge pipe is conducted downwardly but also the liquid running downwardly along the outer surface of the tube and the liquid discharged by the guide element can be introduced into the discharge pipe. The pipe narrowing formed as bridging member enables beside itself an inflowing of the liquid of the guide element into the lower tube portion.

This embodiment of a film trap has the advantage that no additional discharge pipe is necessary.

According to still another embodiment the tube has a gas flow guide portion below the guide element in order to favor the desired helical guidance of the gas.

Preferably, the inventive tube is a vertically arranged tube. However, this does not exclude that the tube can be also formed as horizontally or obliquely arranged tube. In any case, the invention is suited for any tubing that serves for the conduction or discharge of wet gases.

The guide element can be removably fixed at the inner wall of the tube, for instance by screwing, but can be also integrally formed with the inner wall, for instance by welding or laminating. Suitable materials are plastic materials, especially fiber glass reinforced plastics (FRP), PP, as well as metals.

According to another embodiment of the invention the width of the guide element narrows over the length of the tube. For instance, if the guide element is formed as duct or groove the width of the duct can narrow. According to this embodiment the width of the guide element is adapted to the size of the volume flow of the liquid that is to be discharged that, of course, is larger in the beginning range of the tube than in the terminating range of the same. The narrowing of the guide element can take place continuously or stepwisely.

According to still another embodiment of the invention the guide element has a varying slope. Here, the slope can be individually adapted to the respective circumstances, for instance, can be formed smaller in the beginning range of the tube than in the terminating range.

According to still another embodiment the tube has two or more guide elements. For instance, according to this embodiment two or more guide elements can be arranged in a spaced condition and parallel with respect to one another. With two guide elements, for instance, the same can begin at a position offset about half of the circumference of the tube and can extend parallel with respect to one another or can wind upwardly with vertically arranged tubes. By this, the rotation effect achieved by the guide element can be enforced and length or height with regard to the tube or the wet chimney can be saved.

Furthermore, the present invention is directed to a guide element for the installation in a tube with the above-described features. Such a guide element can form a construction unit, preferably together with a tube, especially an inner tube.

BRIEF DESCRIPTION OF THE DRAWING

In the following the invention is described by means of an example in connection with the drawing in detail. In the drawing.

SPECIFIC DESCRIPTION OF THE INVENTION

Figure 1:
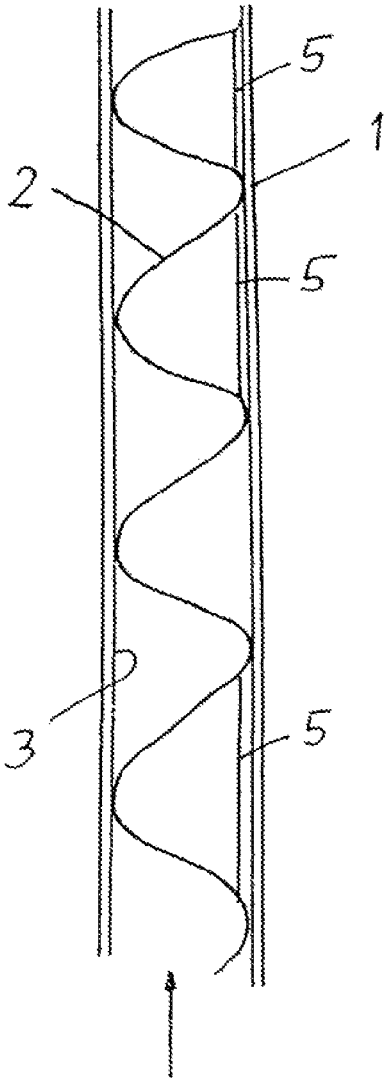
FIG. 1 shows a schematic longitudinal section through a part of a wet chimney.

FIG. 1 shows a schematic part longitudinal section through a wet chimney 1. The inner wall 3 of the wet chimney is provided with a helical guide element 2 that extends over the length of the wet chimney. The inner wall 3 can be, for example, the inner wall of the chimney casing or the inner wall of a chimney tube that is inserted into a chimney casing.

The wet chimney 1 follows the wet scrubber of flue gases and serves for discharging the flue gases into the atmosphere. The gas flow is directed from below to above in FIG. 1. The gas flow is applied with a rotary movement or a helical movement by the guide element 2 arranged at the inner wall 3 of the wet chimney 1 so that the liquid droplets entrained in the gas impinge the inner wall 3 of the chimney by centrifugal forces and are discharged there downward by means of the provided helical or spiral guide element 2. Discharge channels are disposed in certain spacings at the wet chimney and extend outwardly through the chimney wall in order to discharge the liquid transported downward by the guide element 2 out of the chimney and thus to prevent the liquid from reentering the main flow. The discharge channel can be also realized by a pipe in the interior of the chimney.

Figure 2:
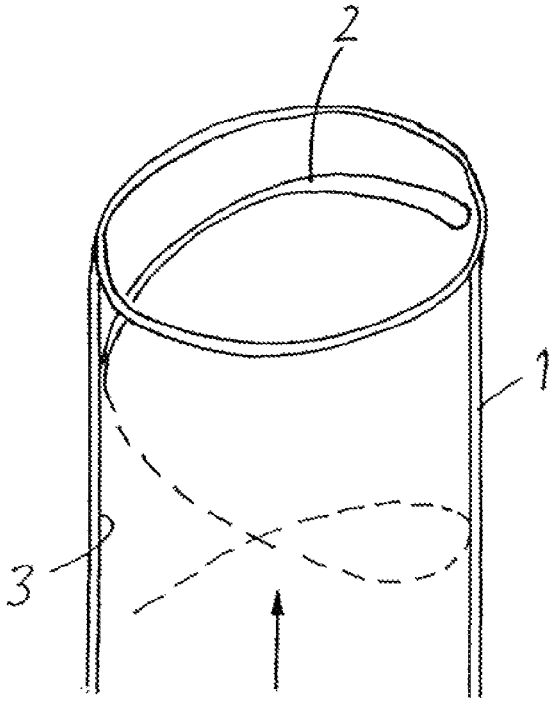
FIG. 2 shows a spatial representation of a part of the wet chimney of FIG. 1 in an enlarged scale.

Accordingly, the helical or spiral guide element 2 on the one hand applies a rotary or helical movement to the gas flow and on the other hand serves for discharging the liquid collected in the range of the inner wall 3 of the chimney. For this, the guide element is formed in a concave manner with the shape of a duct or groove as especially shown in FIG. 2. As already mentioned above, discharge channels are spaced along the length of the wet chimney, and these discharge channels are connected to the guide element 2 in order to discharge the liquid transported downward out of the chimney. Corresponding weirs can be arranged upstream of these discharge channels in order to stem the discharge liquid. These weirs are not shown in the figures either.

Figure 3:
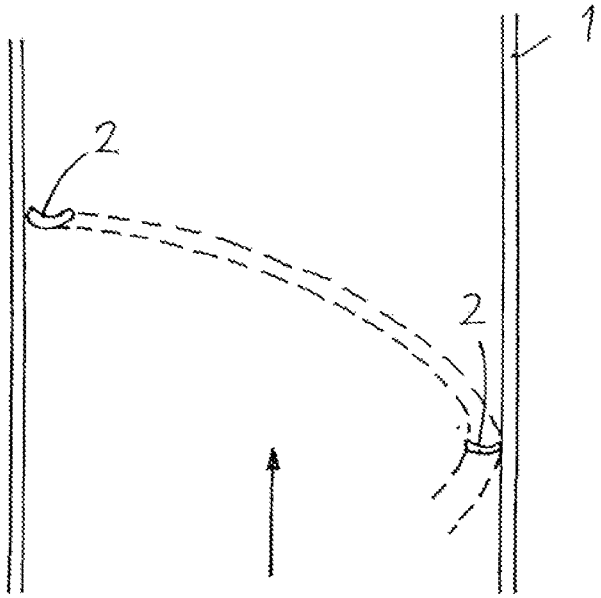
FIG. 3 shows a longitudinal section through a part of the wet chimney shown in FIGS. 1 and 2, again enlarged.

FIG. 3 shows in an enlarged section the formation of the guide element 2 with the shape of a concave duct.

The width of the guide element 2 is dimensioned such that the guide element can apply a sufficiently large rotary or helical movement to the gas flow and furthermore can realize its function as liquid discharge element. A width that is too large is not desired in order to not cause a too strong energy descent of the gas flow. Preferred width ranges are indicated above in the specification. Corresponding considerations relate to the slope of the guide element 2. Also the slope should be optimized such that the guide element can fulfil the above-described two functions. Preferred ranges are also indicated above.

It is essential that the inner range of the wet chimney is kept free of installations in order to not cause a too strong energy descent with respect to the gas flow. Furthermore, the guide element should prevent liquid collected in the range of the inner wall of the chimney from reentering into the inner region and being entrained there by the gas flow. The corresponding dimensioning of the guide element is to be optimized according to the flow conditions residing in the wet chimney.

Figure 4:
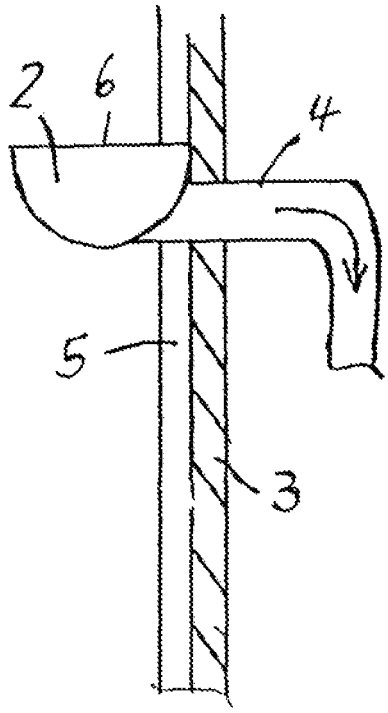
FIG. 4 shows a detail view of the wet chimney in vertical section.
Figure 5:
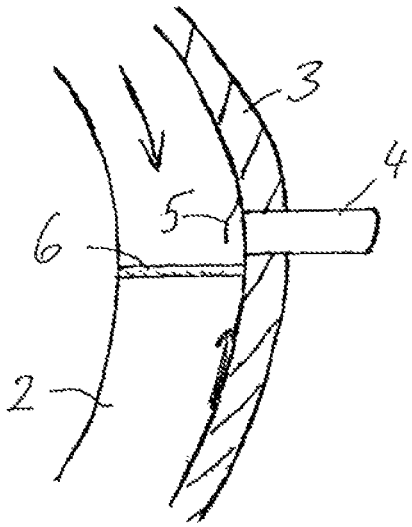
FIG. 5 shows a detail view of the wet chimney in horizontal section.

FIG. 4 shows a detail view of the wet chimney 1 in vertical section. One recognizes the guide element 2 having the shape of a duct or groove and a corresponding weir 6 with a discharge pipe 4 that extends outwardly through the inner wall of the chimney. Furthermore, a film trap 5 at the inner wall 3 of the chimney is formed as a web between the individual portions of the guide element that extends vertically at the inner wall 3 (also shown in FIG. 1). The film trap 5 prevents the liquid film formed at the inner wall from being displaced upward by the rotary flow. The film arrives at the bag-like film trap and runs from there downward into the groove-like guide element 2 from which it is discharged through the discharge pipe 4. In the horizontal section of FIG. 5 the upper arrow shows the draining direction of the liquid on the guide element and the lower arrow shows the upward movement of the gas flow. Furthermore, FIG. 5 shows a weir 6 on the guide element 2.

Figure 6:
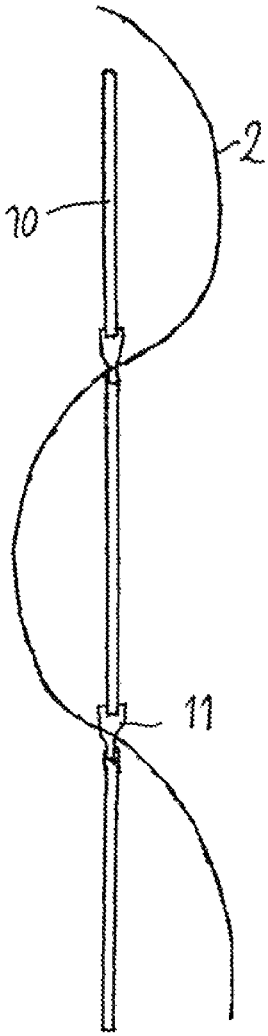
FIG. 6 shows a detail view of another embodiment of a wet chimney.
Figure 7:
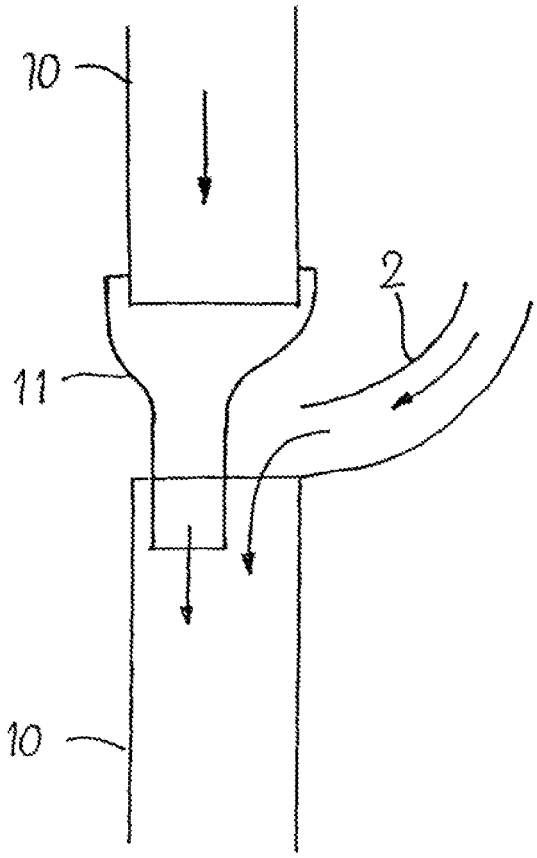
FIG. 7 shows an enlarged view of a detail of FIG. 6.

FIG. 6 shows a view of another embodiment of a film trap that, in this case, has the shape of a discharge pipe 10 at the inner wall of the wet chimney. The discharge pipe 10 is distributed in several discharge pipe portions one upon another that are connected at the places at which they cross the guide element 2 by means of bridging members (pipe narrowings) 11. FIG. 7 shows an enlarged view of such an intersection with the guide element 2. The connection between the two portions of the discharge pipe 10 is formed by a pipe narrowing 11 (bridging member) that narrows toward the lower discharge pipe portion and laterally frees a part of the opening of the lower discharge pipe portion so that the liquid flowing downward on the outer surface of the discharge pipe and the liquid discharged by the guide element 2 can flow into the lower discharge pipe portion.

Figure 8:
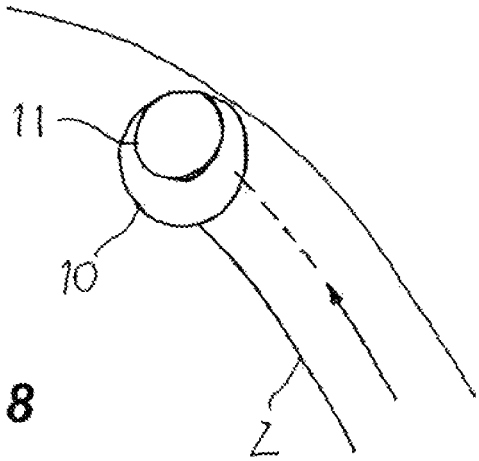
FIG. 8 shows a top view of the subject of FIG. 7.

FIG. 8 shows a schematic top view of the embodiment of FIG. 7.

The invention claimed is:

1. A generally vertical tube for upward conduction or discharge along an axis of wet flue gases subjected to a scrubbing, the tube comprising: a helically formed guide element directly an inner surface of the tube and having a plurality of turns; a film trap formed by a generally axially extending planar or curved plate projecting inwardly from the inner surface of the tube between adjacent turns of the guide element so as to intercept droplets on the inner surface; and at least one weir on the guide element and provided with a discharge channel.

2. The tube according to claim 1, wherein the guide element has a width of 1/80 D-1/5 D, where D is an inner diameter of the tube.

3. The tube according to claim 1, wherein a slope of the guide element is ½ D to 10 D, where D=an inner diameter of the tube.

4. The tube according to claim 1, wherein an inclination of the guide element from a center of the tube to an inner surface of the tube is 0°-60°.

5. The tube according to claim 1, wherein an inner edge of the guide element is canted in a gas-flow direction.

6. The tube according to claim 1, wherein the guide element is formed concave over its width.

7. The tube according to claim 1, wherein the guide element is formed as a passage or groove.

8. The tube according to claim 1, wherein the inner surface of the tube is formed by an inner tube arranged in an outer casing.

9. The tube according to claim 1, wherein the tube is formed as a wet chimney.

10. The tube according to claim 1, wherein the film trap is associated with a discharge pipe.

11. The tube according to claim 1, further comprising:

a gas flow guide portion below the guide element.

12. The tube according to claim 1, wherein a width of the guide element narrows along a length of the tube.

13. The tube according to claim 1, wherein the guide element has a varying slope.

14. The tube according to claim 1, wherein the tube has two or more of the guide elements.

15. A tube for the conduction or discharge of wet flue gases subjected to a scrubbing, the tube comprising:

a helically formed guide element on an inner surface of the tube and having a plurality of turns; and a film trap on the inner surface of the tube between adjacent turns of the guide element and formed by an axially extending discharge pipe into which the guide element opens.

16. The tube according to claim 15, wherein the discharge pipe bridges the guide element by means of a pipe narrowing.

* * * * *